US009199146B2

(12) United States Patent
Lamkin et al.

(10) Patent No.: US 9,199,146 B2
(45) Date of Patent: Dec. 1, 2015

(54) GOLF GRIP WITH RAKED GRIPPING FEATURES

(71) Applicant: Lamkin Corporation, San Diego, CA (US)

(72) Inventors: Robert J. Lamkin, San Diego, CA (US); Carl Pettersen, San Diego, CA (US); Carlos Rodriguez, Tijuana (MX); Raul Medina, Tijuana (MX); Andrew Kerr, San Diego, CA (US); Feliciano Guillen, Tijuana (MX); Peter Brown, San Diego, CA (US); Adam Colton, San Diego, CA (US); Kerri Kauffman, San Diego, CA (US); Patricia Marquez, Tijuana (MX); Denisse Camou, Tijuana (MX); Ricardo Medina, Tijuana (MX)

(73) Assignee: Lamkin Corporation, San Diego, CA (US)

( * ) Notice: Subject to any disclaimer, the term of this patent is extended or adjusted under 35 U.S.C. 154(b) by 132 days.

(21) Appl. No.: 13/828,564

(22) Filed: Mar. 14, 2013

(65) Prior Publication Data

US 2014/0274443 A1 Sep. 18, 2014

(51) Int. Cl.
*A63B 53/14* (2015.01)

(52) U.S. Cl.
CPC ..... *A63B 53/14* (2013.01); *A63B 2209/00* (2013.01)

(58) Field of Classification Search
CPC ..... A63B 53/14; A63B 59/0029
USPC ..... 473/300–303
See application file for complete search history.

(56) References Cited

U.S. PATENT DOCUMENTS

| | | | | | |
|---|---|---|---|---|---|
| 610,471 | A | * | 9/1898 | Cavanagh | 74/551.9 |
| 1,419,795 | A | | 6/1922 | Yerger | |
| 1,638,454 | A | | 8/1927 | Papin | |
| 2,446,622 | A | * | 8/1948 | Turner | 69/21 |
| 2,468,202 | A | * | 4/1949 | Karns | 473/300 |
| 3,140,873 | A | * | 7/1964 | Goodwin | 473/302 |
| 4,376,536 | A | | 3/1983 | Martin | |
| 4,850,079 | A | | 7/1989 | Thompson | |
| 4,867,453 | A | | 9/1989 | Winters | |
| 4,919,861 | A | | 4/1990 | Schutes | |
| 4,972,733 | A | | 11/1990 | Olmr et al. | |
| 5,097,566 | A | * | 3/1992 | Decker et al. | 16/421 |
| D356,616 | S | * | 3/1995 | Jacques | D21/756 |
| 5,419,031 | A | * | 5/1995 | McLendon | 29/450 |
| 5,637,043 | A | * | 6/1997 | Fortis | 473/302 |
| 5,686,158 | A | * | 11/1997 | Gibbon | 428/36.92 |
| D408,461 | S | * | 4/1999 | Lamkin | D21/757 |
| 6,482,113 | B1 | | 11/2002 | Finn | |
| 6,656,057 | B2 | * | 12/2003 | Manual et al. | 473/300 |

(Continued)

FOREIGN PATENT DOCUMENTS

| | | | | | |
|---|---|---|---|---|---|
| JP | 01037968 | A | * | 2/1989 | A63B 53/14 |
| JP | 09187540 | A | * | 7/1997 | A63B 53/14 |

*Primary Examiner* — Stephen Blau
(74) *Attorney, Agent, or Firm* — Procopio, Cory, Hargreaves & Savitch LLP; Jacob Beers

(57) ABSTRACT

A golf grip for a golf club includes a butt end, a tip end, a grip surface, and a gripping feature. The tip end includes a shaft opening. The grip surface extends between the butt end and the tip end. The grip surface is a tapered circular cylinder with an axis extending from the butt end to the tip end. The gripping feature includes a rake surface forming an acute angle with the grip surface. The rake surface extends into the grip at an acute angle relative to a plane perpendicular to the axis.

19 Claims, 8 Drawing Sheets

(56) References Cited

U.S. PATENT DOCUMENTS

| | | | | |
|---|---|---|---|---|
| 6,723,006 | B1 * | 4/2004 | Lin | 473/300 |
| 6,971,959 | B1 * | 12/2005 | Lu | 473/302 |
| 6,974,626 | B2 * | 12/2005 | Horacek | 428/354 |
| 7,261,639 | B2 | 8/2007 | Smith et al. | |
| 8,016,692 | B2 * | 9/2011 | Kumamoto | 473/303 |
| 2003/0088946 | A1 * | 5/2003 | Ferguson et al. | 16/431 |
| 2006/0205530 | A1 * | 9/2006 | Huang | 473/300 |
| 2012/0129624 | A1 * | 5/2012 | Ito et al. | 473/303 |

* cited by examiner

GOLF GRIP WITH RAKED GRIPPING FEATURES

TECHNICAL FIELD

The present disclosure generally pertains to golf grips, and is also directed toward a golf grip including angled recessed or protruded features.

BACKGROUND

Grips for sporting implements such as golf clubs have taken numerous forms over the years. Early grips consisted of a wrap material, such as leather, in a helical pattern around the handle portion of the golf club. Over the years other materials such as polyurethane have been used as a wrap material.

Golf grips have evolved from the wrap type grip to a tapered cylinder of rubber, polyurethane, TPE, or similar elastomeric and shock absorbing materials that slip over the butt end of a golf club shaft. Golf grips may also include fibers, cords, fabric, or cork imbedded within the elastomeric materials. Golf grips are generally formed by a compression molding or an injection molding process.

The material from which a golf grip is made may be relatively hard to avoid torsion of the golf club. The harder surface may be undesirable for obtaining the desired friction between the golf grip and the user's hands. Most golf grips include features that recede into or protrude out from the surface of the golf grip. These features may provide traction to help a golfer retain the club securely in the golfer's hands.

SUMMARY OF THE DISCLOSURE

A golf grip for a golf club includes a butt end, a tip end, a grip surface, and a gripping feature. The tip end includes a shaft opening. The grip surface extends between the butt end and the tip end with an axis extending from the butt end to the tip end. The gripping feature includes a rake surface forming an acute angle with the grip surface. The rake surface extends into the grip at an acute angle relative to a plane perpendicular to the axis.

Other features and advantages of the present invention should be apparent from the following description which illustrates, by way of example, aspects of the invention.

DETAILED DESCRIPTION

The apparatus disclosed herein includes a golf grip with gripping features raked in the axial direction or in the circumferential direction of the golf grip. The rake may be angled in the direction of an inertial force (centrifugal force) or in the direction of a rotational force (torque). The rake formed between the gripping features and a golfer's hands may increase the friction between the golfer's hands and the golf grip. The rake of the gripping feature may also create a mechanical interface with the golfer's hand which may resist the inertial or rotational forces of the golf club.

Figure 1:
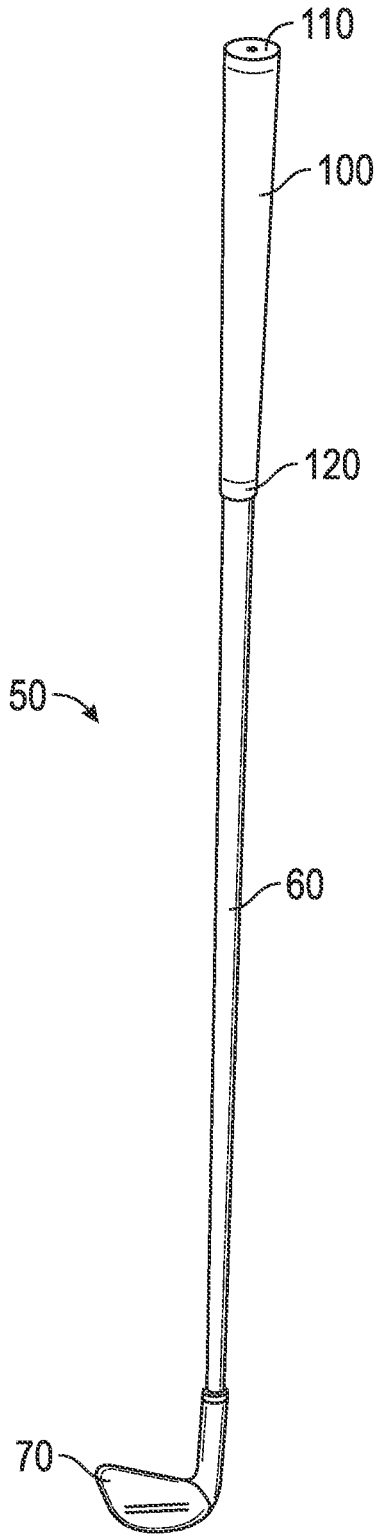
FIG. 1 is a perspective view of a golf club including a golf grip.

FIG. 1 is a perspective view of a golf club 50 with a golf grip ("grip") 100. Golf club 50 includes a shaft 60, a club head 70, and a golf grip such as grip 100. The shaft 60 may be a steel or graphite cylindrical tube. The length of shaft 60 is generally determined by the type of club head attached and by the length of the measurement from the golfer's wrist to the floor. The club head 70 may be formed from any number of materials from processes such as forging and casting. Club head 70 may be any type of club head such as a driver, wood, hybrid, iron, or putter club head. Club head 70 is affixed to one end of shaft 60.

Grip 100 is affixed to the shaft 60 at the end distal to club head 70. Grip 100 includes a butt end 110 and a tip end 120. Grip 100 is affixed to shaft 60 by inserting shaft 60 into the tip end 120 of grip 100.

Figure 2:
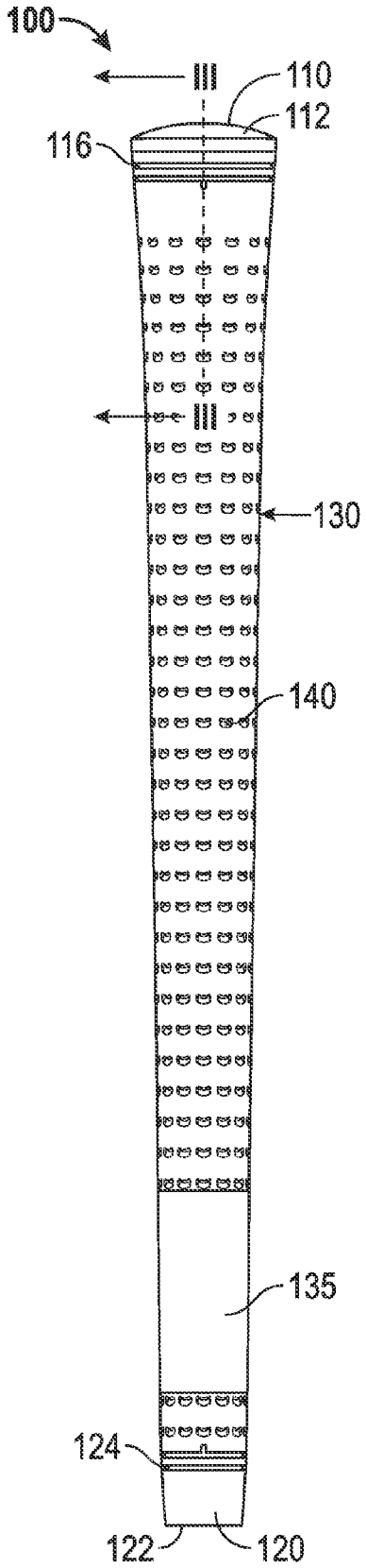
FIG. 2 is a plan view of an exemplary golf grip with raked gripping features.

FIG. 2 is a plan view of an exemplary grip 100 with gripping features 140. Grip 100 has the shape of a hollow cylinder or tube extending from a closed butt end 110 to an open tip end 120. Grip 100 includes grip surface 130, the outer surface of the cylindrical shape. Grip surface 130 extends between butt end 110 and tip end 120. Grip surface 130 may taper from butt end 110 to tip end 120 with the width or diameter of grip surface 130 getting progressively smaller from butt end 110 to tip end 120. The cross-section of grip 100 at grip surface 130 may be a circle, an ellipse, a stadium shape, or other similar shapes.

Figure 3:
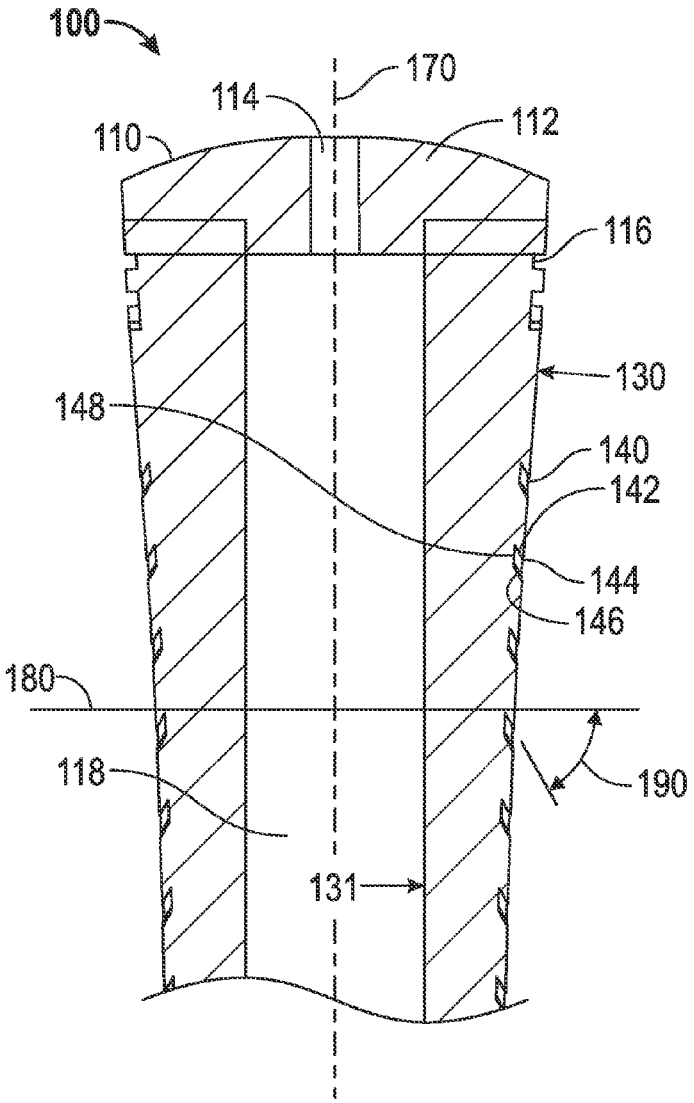
FIG. 3 is a cross-sectional view of a portion of the golf grip of FIG. 2 including the butt end.

FIG. 3 is a cross-sectional view of a portion of the grip 100 of FIG. 2 taken along line III-III. Each grip may include an axis, such as axis 170. All references to radial, axial, and circumferential directions and measures refer to the grip axis, unless specified otherwise, and terms such as "inner" and "outer" generally indicate a lesser or greater radial distance from the axis.

Referring to FIGS. 2 and 3, the butt end 110 of grip 100 may include an end cap 112 and butt end features 116. End cap 112 has a circular or disk shape that closes the cylindrical shape of grip 100 at butt end 110. End cap 112 may include a vent hole 114. Vent hole 114 may be used to insert compressed air during installation and removal of grip 100 from a golf club.

Butt end features 116 may be aesthetic features such as trim rings extending around the circumference of grip surface 130 proximal to end cap 112. Butt end features 116 may be slots in grip 100 and may have a color that is different than the color of grip surface 130. In the embodiment shown in FIGS. 2 and 3, butt end features 116 are two circumferential slots that extend completely around grip surface 130. In another embodiment, butt end features are two rows of two circumferential slots with each circumferential slot in each row having a semicircular shape.

Referring to FIG. 3, tip end 120 may include shaft opening 122 and tip end features 124. Shaft opening 122 is an opening at the tip of grip 100. Shaft opening 122 is configured for a shaft to be inserted into shaft opening 122 during installation of grip 100 onto a shaft. Tip end features 124 may be aesthetic features such as trim rings extending around the circumference of grip surface 130 proximal to shaft opening 122. Tip end features may be slots in grip 100 and may have a color that is different than the color of grip surface 130. In the embodiment shown in FIG. 3, tip end features 124 are two circumferential slots that extend completely around grip surface 130. In another embodiment, tip end features 124 are two rows of two circumferential slots with each circumferential slot in each row having a semicircular shape.

Grip 100 includes shaft cavity 118. Shaft cavity 118 is the hollow portion of grip 100 sized relative to the diameter of the shaft. Shaft cavity 118 extends from shaft opening 122 towards butt end 110. Shaft cavity 118 is generally a right circular cylinder and includes shaft mating surface 131. Shaft mating surface 131 may be a right cylindrical surface. Grip 100 may include axis 170. Axis 170 may be the axis of the cylindrical shape of grip 100, the axis of shaft cavity 118, and the axis of shaft mating surface 131.

Referring now to FIGS. 2 and 3, grip 100 also includes multiple gripping features 140. Gripping features 140 may recede into grip 100 at grip surface 130. Gripping features 140 at grip surface 130 may have any geometric shape. In the embodiment shown in FIG. 2, gripping feature 140 is an enclosed shape with four minor arcs including two similarly shaped arcs offset in the axial direction; the top arc, closest to end cap 112 is concave and the bottom arc, closest to shaft opening 122 is convex; the endpoints of the top arc and the bottom arc are connected by convex side arcs. In other embodiments, the shape of gripping feature 140 may be rectangular, circular, linear, or irregularly shaped.

Figure 8:
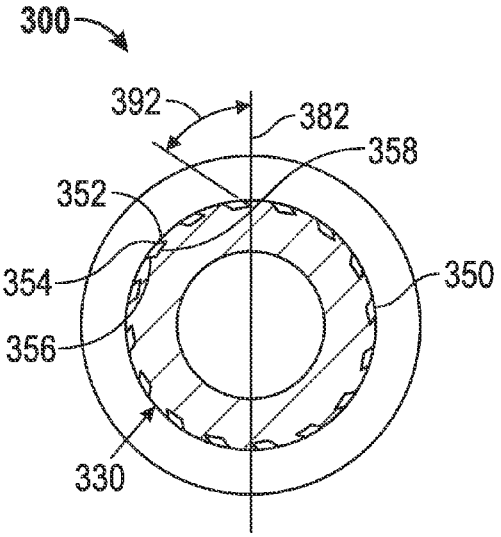
FIG. 8 is a cross-sectional view of the golf grip of FIG. 6.
Figure 9:
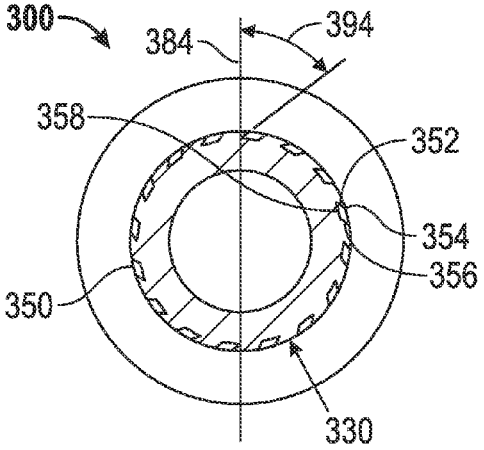
FIG. 9 is a cross-sectional view of the golf grip of FIG. 6.

Referring now to FIG. 3, each gripping feature 140 rakes into grip 100 at an inclination from plane 180 at angle 190, rakes into grip 100 at an inclination from a plane that includes axis 170 (as illustrated in FIGS. 8 and 9), or at an inclination from a golfer's hand. Plane 180 is perpendicular to axis 170. Angle 190 may be angled from plane 170 towards tip end 120. Angle 190 is an acute angle. In one embodiment, angle 190 is between zero and ninety degrees. In another embodiment, angle 190 is from three to eighty-seven degrees. In another embodiment, angle 190 is from five to eighty-five degrees. In another embodiment, angle 190 is from fifteen to seventy-five degrees. In yet another embodiment, angle 190 is from ten to fifty degrees. In the embodiment shown in FIG. 3, angle 190 is sixty degrees. The angle formed relative to a golfer's hand may equal or be similar to the complementary angle of angle 190. Each gripping feature 140 may curve as it extends into grip 100.

Each gripping feature 140 may include rake surface 142, rake edge 144, offset surface 146, and internal surface 148. Rake surface 142 may extend into the grip from grip surface 130 or out from grip surface 130. Rake surface 142 may be angled at angle 190 and may form an acute angle with grip surface 130. The direction of the portion of rake surface 142 adjacent grip surface 130 is angled from a direction perpendicular to axis 170 at an acute angle. Rake surface 142 may be the portion of a curved or cylindrical surface that forms an acute angle with grip surface 130. Rake surface 142 may be the surface of gripping feature 140 partially facing the direction the force gripping feature 140 is designed to oppose. In the embodiment shown in FIG. 3, rake surface 142 is partially facing in the axial direction towards tip end 120. For some curved rake surfaces 142, the tangential or radial angle of the curved rake surface 142 at grip surface 130 would be the same as angle 190.

Rake surface 142 may have a curved or linear profile. The initial direction of the profile of the rake surface 142 from the grip surface 130 into the grip 100 may be angled from a direction perpendicular to axis 170 at an acute angle.

Rake edge 144 is the edge formed at the outer tip of rake surface 142. In some embodiments, rake edge 144 is the edge formed at the acute angle between rake surface 142 and grip surface 130. Rake edge 144 may be facing the direction the force gripping feature 140 is designed to oppose. In the embodiment shown in FIG. 3, rake edge 144 is facing in the axial direction towards tip end 120.

Offset surface 146 is the surface opposite rake surface 142. Offset surface may be offset from rake surface 142 and may be at angle 190. Offset surface 146 may be a plane or a curved surface. Offset surface 146 may form an obtuse angle with grip surface 130, may be perpendicular to grip surface 130, or may form a rake in the direction opposite rake surface 142. The connection between offset surface 146 and grip surface 130 may be an edge or a round.

Internal surface 148 is the surface within gripping feature 140 that intersects rake surface 142 and offset surface 146. Internal surface 148 may be parallel to grip surface 130. In some embodiments, offset surface 146 directly intersects rake surface 142; these embodiments may not include internal surface 148.

In one embodiment, grip surface 130 includes a cylindrical portion and multiple indentations. Each indentation includes a rake surface 142. Each rake surface 142 extends from rake edge 144 at the cylindrical portion of grip surface 130 into grip 100 to an inner edge. The inner edge is located radially inward from rake edge 144 and axially closer to butt end 110.

In another embodiment a gripping feature with a rake surface may extend out from grip surface. The rake surface may extend out from grip surface and may also form an acute angle with the grip surface.

Figure 4:
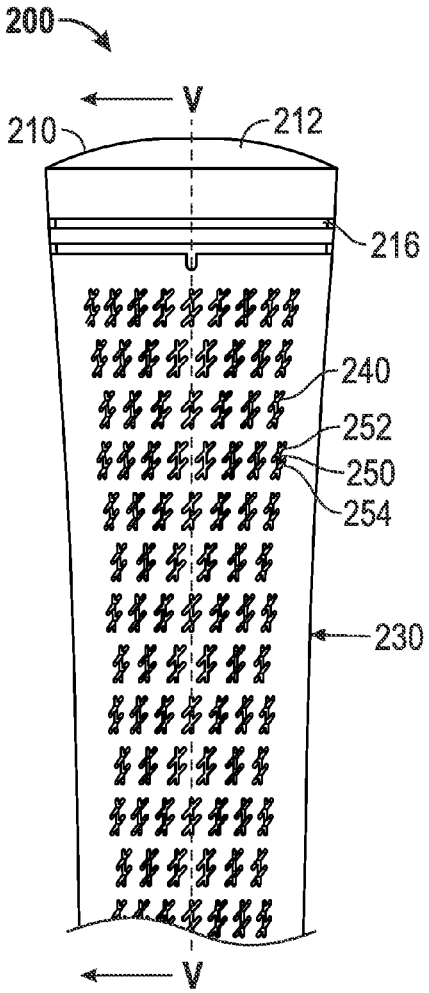
FIG. 4 is a plan view of a portion of an exemplary golf grip with raked crossed line gripping features.

FIG. 4 is a plan view of a portion of an exemplary golf grip 200 including the butt end 210 with raked crossed line gripping features 240. Each golf grip described herein may include the same or similar components. Like or similar components may be similarly numbered (for example, butt end 210 of grip 200 may be the same or similar to butt end 110 of grip 100). Each crossed line gripping feature 240 includes vertical line 250, first angled line 252, and second angled line 254. Vertical line 250 may run along grip surface 230 in the axial direction of grip 200, parallel to axis 270. First angled line 252 runs along grip surface 230 at an angle to vertical line 250, crossing vertical line 250 between the midpoint and one end of vertical line 250. Second angled line 254 runs along grip surface parallel to first angled line crossing vertical line 250 between the midpoint and the other end of vertical line 250. First angled line 252 and second angled line 254 may cross vertical line 250 at the midpoints of first angled line 252 and second angled line 254 respectively.

Figure 5:
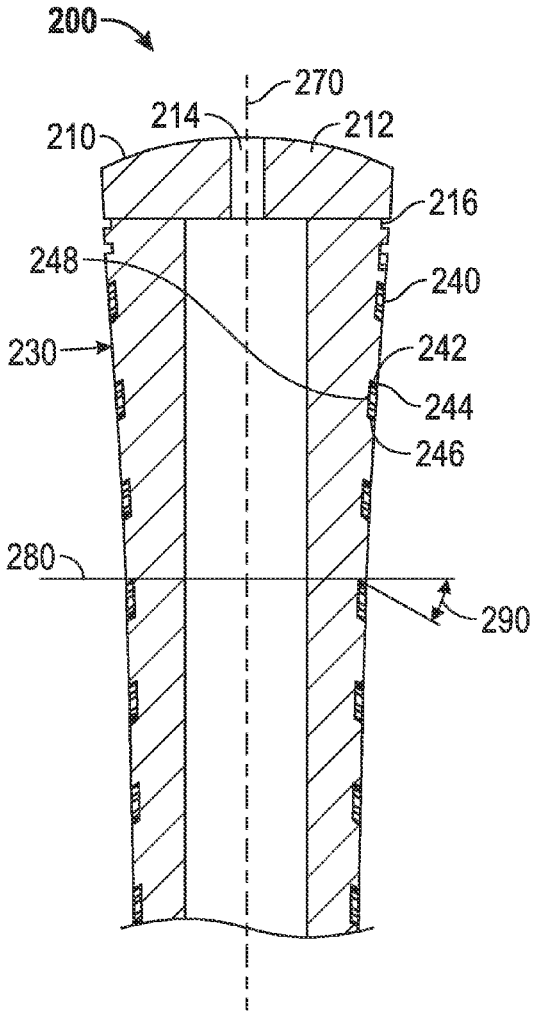
FIG. 5 is a cross-section of a portion of the golf grip of FIG. 4 including the butt end.

FIG. 5 is a cross-sectional view of the portion of the grip 200 of FIG. 4 taken along line V-V. Like gripping feature 140, crossed line gripping feature 240 rakes into grip 200 at an inclination from plane 270 at angle 290, rakes into grip 200 at an inclination from a plane that includes axis 270 (similar to raking feature illustrated in FIGS. 8 and 9), or at an inclination from a golfer's hand. Plane 280 is perpendicular to axis 270. Angle 290 may be angled from plane 270 away from end cap 212 and in the general direction of the tip end of grip 200. In one embodiment, angle 290 is between zero and ninety degrees. In another embodiment, angle 290 is from three to eighty-seven degrees. In another embodiment, angle 290 is from five to eighty-five degrees. In another embodiment, angle 290 is from fifteen to seventy-five degrees. In yet another embodiment, angle 290 is from ten to fifty degrees. In the embodiment shown in FIG. 3, angle 290 is thirty degrees. The angle formed relative to a golfer's hand may equal or be similar to the complementary angle of angle 290.

Each sub-feature including vertical line 250, first angled line 252, and second angled line 254 of crossed line gripping feature 240 may include a rake surface 242, a rake edge 244, an offset surface 246, and an internal surface 248. Rake surface 242 is angled at angle 290 and forms an acute angle with grip surface 230. Similar to rake surface 142, each rake surface 242 may be the surface of crossed line gripping feature 240 partially facing the direction the force crossed line gripping feature 240 is designed to oppose. In the embodiment shown in FIG. 5, each rake surface 242 is partially facing in the axial direction towards the tip end of grip 200.

Like rake edge 144, rake edge 244 is the edge formed at the outer tip of rake surface 242. In some embodiments, rake edge 244 is the edge formed at the acute angle between rake surface 242 and grip surface 230. Each rake edge 244 may be facing the direction the force crossed line gripping feature 240 is designed to oppose. In the embodiment shown in FIG. 5, each rake edge 244 is facing in the axial direction towards the tip end of grip 200.

Each offset surface 246 and each internal surface 248 of crossed line gripping feature 240 may be situated and constructed in the same or a similar manner as offset surface 146 and internal surface 148 respectively.

Figure 6:
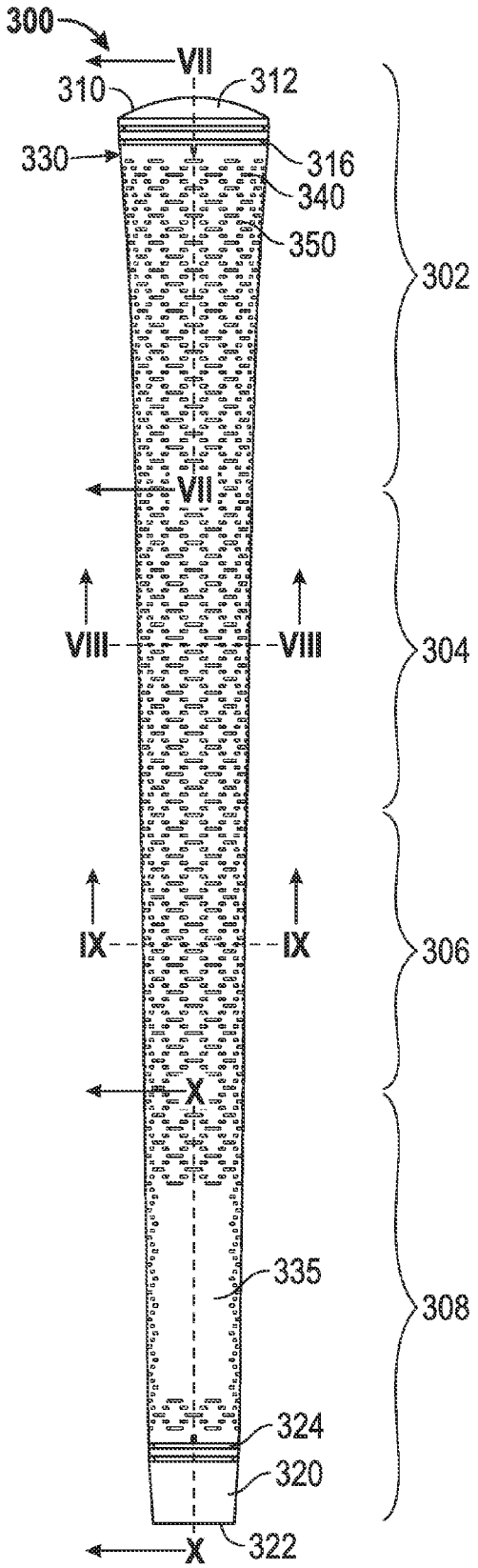
FIG. 6 is a plan view of an exemplary golf grip with gripping features with varying shapes, varying rake angles, and directions.

FIG. 6 is a plan view of an exemplary grip 300 with gripping features with varying shapes, varying rake angles, and directions. Like grips 100 and 200, grip 300 includes grip surface 330 extending between butt end 310 and tip end 320 and may taper with the diameter of grip surface 330 getting progressively smaller from butt end 310 to tip end 320. Also like grip 100, grip 300 may include end cap 312, butt end features 316, shaft opening 322, and tip end features 324. Grip 300 includes first gripping features 340 and second gripping features 350. Grip 300 may include any number of gripping features. Each first gripping feature 340 and each second gripping feature 350 may be a circumferential slot, with first gripping features 340 being at least twice as long as second gripping features 350.

Figure 7:
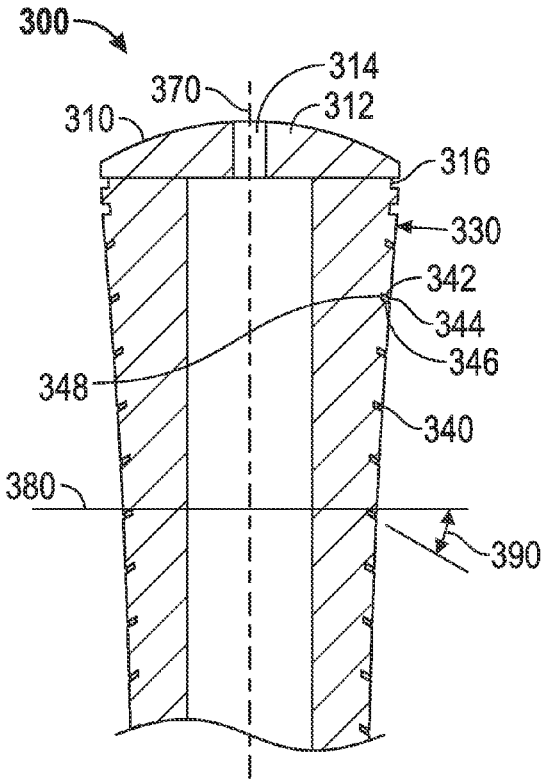
FIG. 7 is a cross-sectional view of a portion of the golf grip of FIG. 6 including the butt end.

Grip 300 may be subdivided into sections. Each section may include gripping features with different rake angles and different directions for the rake angles. In the embodiment shown in FIGS. 6-10, grip 300 includes first section 302, second section 304, third section 306, and fourth section 308. FIG. 7 is a cross-sectional view looking from the side of a portion of the grip 300 of FIG. 6 through multiple first gripping features 340 of first section 302 taken along line VII-VII. First gripping features 340 (as illustrated in FIG. 7) and second gripping features (not shown) in first section 302 rake into grip 300 at an inclination from plane 380 at angle 390 or at an inclination from a golfer's hand. Plane 380 is perpendicular to axis 370. Angle 390 may be angled from plane 380 towards tip end 320. Angle 390 is an acute angle. In the embodiment shown in FIG. 7, angle 390 is thirty degrees. The angle formed relative to a golfer's hand may equal or be similar to the complementary angle of angle 390.

Each first gripping feature 340 may include rake surface 342, rake edge 344, offset surface 346, and internal surface 348. Rake surface 342 is angled at angle 390 and forms an acute angle with grip surface 330. Each rake surface 342 in first section 302 is partially facing in the axial direction towards tip end 320 and rake edge 344 is facing in the axial direction towards tip end 320. The description of first gripping features 340 in first section 302 also applies to second gripping features 350 in first section 302.

FIG. 8 is a cross-sectional view of the grip 300 of FIG. 6 looking from the bottom through multiple second gripping features 350 of second section 304 taken along line VIII-VIII. First gripping features 340 (not shown) and second gripping features (as illustrated in FIG. 8) in second section 304 rake into grip 300 at an inclination from plane 382 that includes axis 370 or at an inclination from a golfer's hand. Angle 392 is angled circumferentially from plane 382 in a counter-clockwise direction. Angle 392 is an acute angle. In the embodiment shown in FIG. 8, angle 392 is thirty-five degrees. The angle formed relative to a golfer's hand may equal or be similar to the complementary angle of angle 392.

Each second gripping feature 350 may include rake surface 352, rake edge 354, offset surface 356, and internal surface 358. Rake surface 352 is angled at angle 392 and forms an acute angle with grip surface 330. Each rake surface 352 in second section 304 is partially facing counter-clockwise in the circumferential direction. The description of second gripping features 350 in second section 304 also applies to first gripping features 340 in second section 304.

FIG. 9 is a cross-sectional view of the grip 300 of FIG. 6 looking from the bottom through multiple second gripping features 350 of third section 306 taken along line IX-IX. First gripping features 340 (not shown) and second gripping features (as illustrated in FIG. 9) in third section 306 rake into grip 300 at an inclination from plane 384 that includes axis 370 or at an inclination from a golfer's hand. Angle 394 is angled circumferentially from plane 384 in a clockwise direction. Angle 394 is an acute angle. In the embodiment shown in FIG. 9, angle 394 is thirty-four degrees. The angle formed relative to a golfer's hand may equal or be similar to the complementary angle of angle 394.

Each second gripping feature 350 may include rake surface 352, rake edge 354, offset surface 356, and internal surface 358. Rake surface 352 is angled at angle 394 and forms an acute angle with grip surface 330. Each rake surface 352 in third section 306 is partially facing clockwise in the circumferential direction. The description of second gripping features 350 in third section 306 also applies to first gripping features 340 in third section 306.

Figure 10:
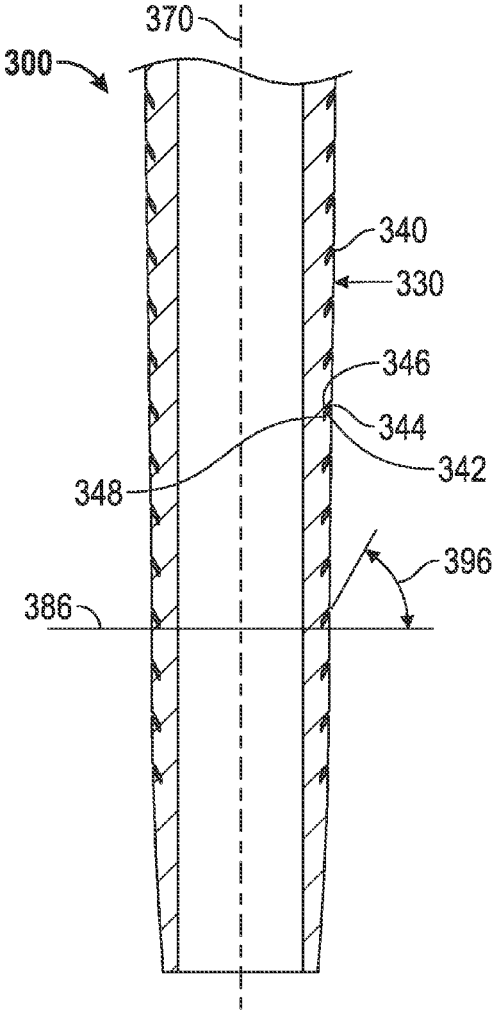
FIG. 10 is a cross-sectional view of a portion of the golf grip of FIG. 6 including the tip end.

FIG. 10 is a cross-sectional view of a portion of grip 300 looking from the side of grip 300 of FIG. 6 through multiple first gripping features 340 of fourth section 308 taken along line X-X. First gripping features 340 (as illustrated in FIG. 10) and second gripping features (not shown) in fourth section 308 rake into grip 300 at an inclination from plane 386 at angle 396 or at an inclination from a golfer's hand. Plane 386 is perpendicular to axis 370. Angle 396 may be angled from plane 386 towards butt end 310. Angle 396 is an acute angle. In the embodiment shown in FIG. 10, angle 396 is sixty degrees. The angle formed relative to a golfer's hand may equal or be similar to the complementary angle of angle 396.

Each first gripping feature 340 may include rake surface 342, rake edge 344, offset surface 346, and internal surface 348. Rake surface 342 is angled at angle 396 and forms an acute angle with grip surface 330. Each rake surface 342 in fourth section 308 is partially facing in the axial direction towards butt end 310 and rake edge 344 is facing in the axial direction towards butt end 310. The description of first gripping features 340 in fourth section 308 also applies to second gripping features 350 in fourth section 308.

Offset surfaces 346 and 356 may be similar in relationship, orientation, shape, and size as offset surface 146. Internal surfaces 348 and 358 may be similar in relationship, orientation, shape, and size as internal surface 148.

Figure 11:
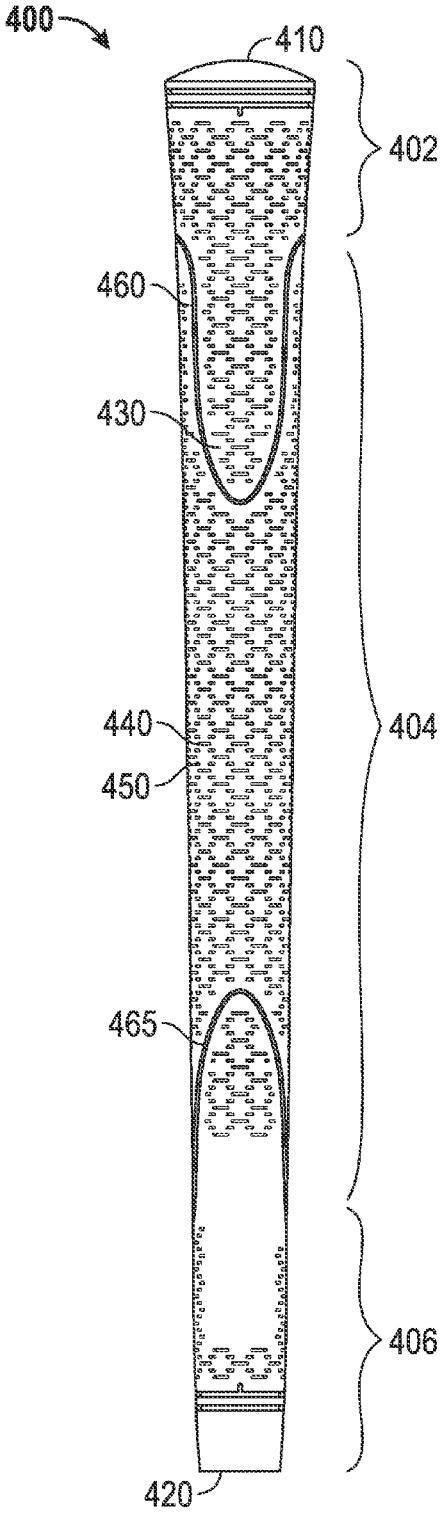
FIG. 11 is a plan view of an exemplary multiple compound golf grip with raked gripping features.

FIG. 11 is a plan view of an exemplary multiple compound grip 400 with raked gripping features. Grip 400 may include some or all of the features described in association with grips 100, 200, and 300. Grip 400 includes multiple sections. Each section may be made from a different material or compound. The embodiment shown in FIG. 11 includes three sections, first material section 402, second material section 404, and third material section 406. First material section 402 is made of a first material; second material section 404 is made of a second material; and third material section 406 is made of a third material or of the first material.

The sections may be divided by a dividing line. Each dividing line may be straight or curved. Each dividing line may recede into or protrude out from grip surface 430. Each dividing line may be raked similar to the gripping features described above. In the embodiment shown in FIG. 11, first material section 402 and second material section 404 are divided by first dividing line 460, and second material section 404 and third material section 406 are divided by second dividing line 465; first dividing line 460 and second dividing line 465 are sinusoidal slots; and first dividing line 460 and second dividing line 465 are raked relative to a plane tangent the dividing line in a direction perpendicular to the plane.

Each section may include gripping features such as first gripping feature 440 and second gripping feature 450. The gripping features in each section may include any of the features described herein. In one embodiment, each section includes similarly oriented gripping features with similar rake angles in the same direction. In another embodiment, each section includes gripping features with rake angles and directions different than the other sections. In yet another embodiment, each section includes multiple rake angles in multiple directions.

Figure 12:
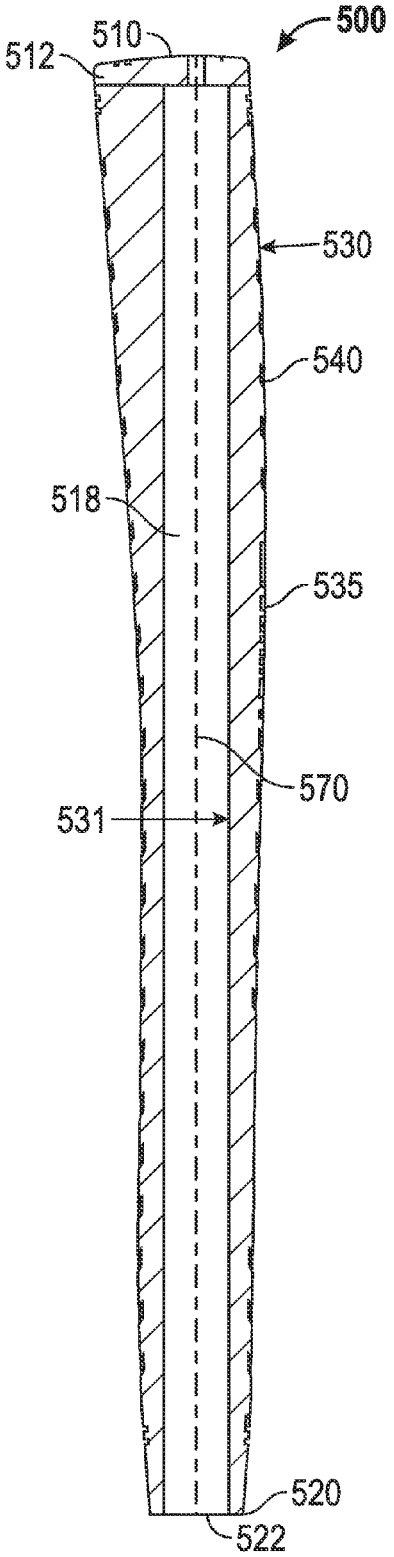
FIG. 12 is a cross-sectional view of an exemplary putter golf grip with raked gripping features.

In some embodiments, the golf grip may be a putter grip. FIG. 12 is a cross-sectional view of an exemplary putter grip 500 with raked gripping features 540. Putter grip 500 may be an irregularly shaped cylinder. Putter grip 500 may have varying thicknesses and may have a slight arc in the cylindrical shape at the butt end 510. Putter grip 500 may transition from a circular cross-section at tip end 520 to a stadium shape or ellipse for the remainder of the putter grip 500. End cap 512 may also be a stadium shape or an ellipse. Like other golf grips, putter grip 500 includes a circular shaft opening 522.

Grip 500 includes shaft cavity 518. Shaft cavity 518 is the hollow portion of grip 500 sized relative to the diameter of the shaft. Shaft cavity 518 extends from shaft opening 522 towards butt end 510. Shaft cavity 518 is generally a right circular cylinder and includes shaft mating surface 531. Shaft mating surface 531 may be a right cylindrical surface. Grip 500 may include axis 570. Axis 570 may be the axis of the axis of shaft cavity 518 and the axis of shaft mating surface 531.

Gripping features 540 may include any of the shapes and features of the gripping features described herein including the various rake angles and directions, and any of the grip features described herein including logo area 535 on grip surface 530.

Figure 13:
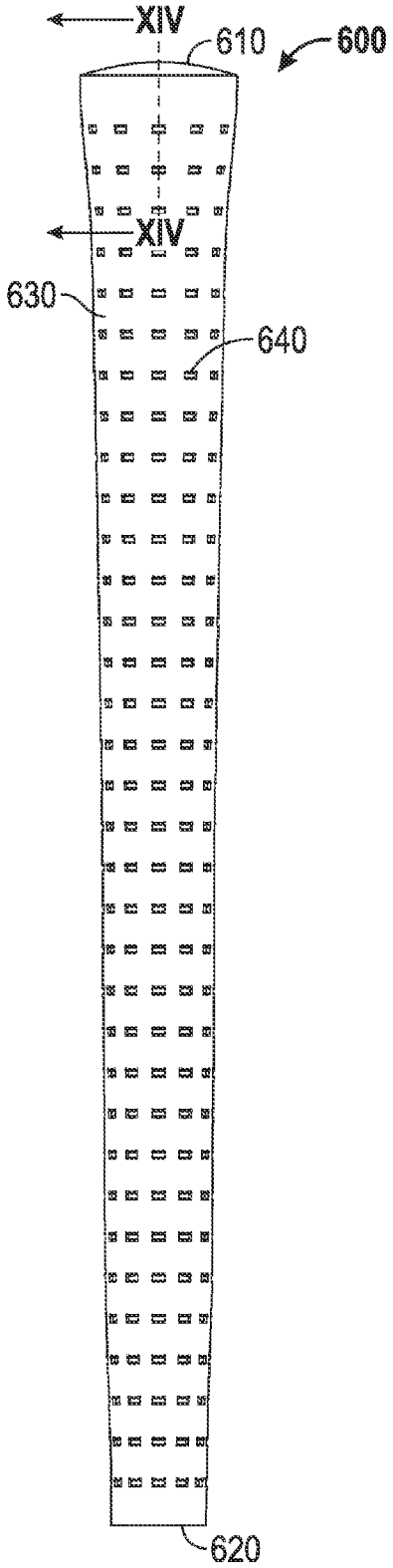
FIG. 13 is a plan view of an exemplary golf grip with raked gripping features.
Figure 14:
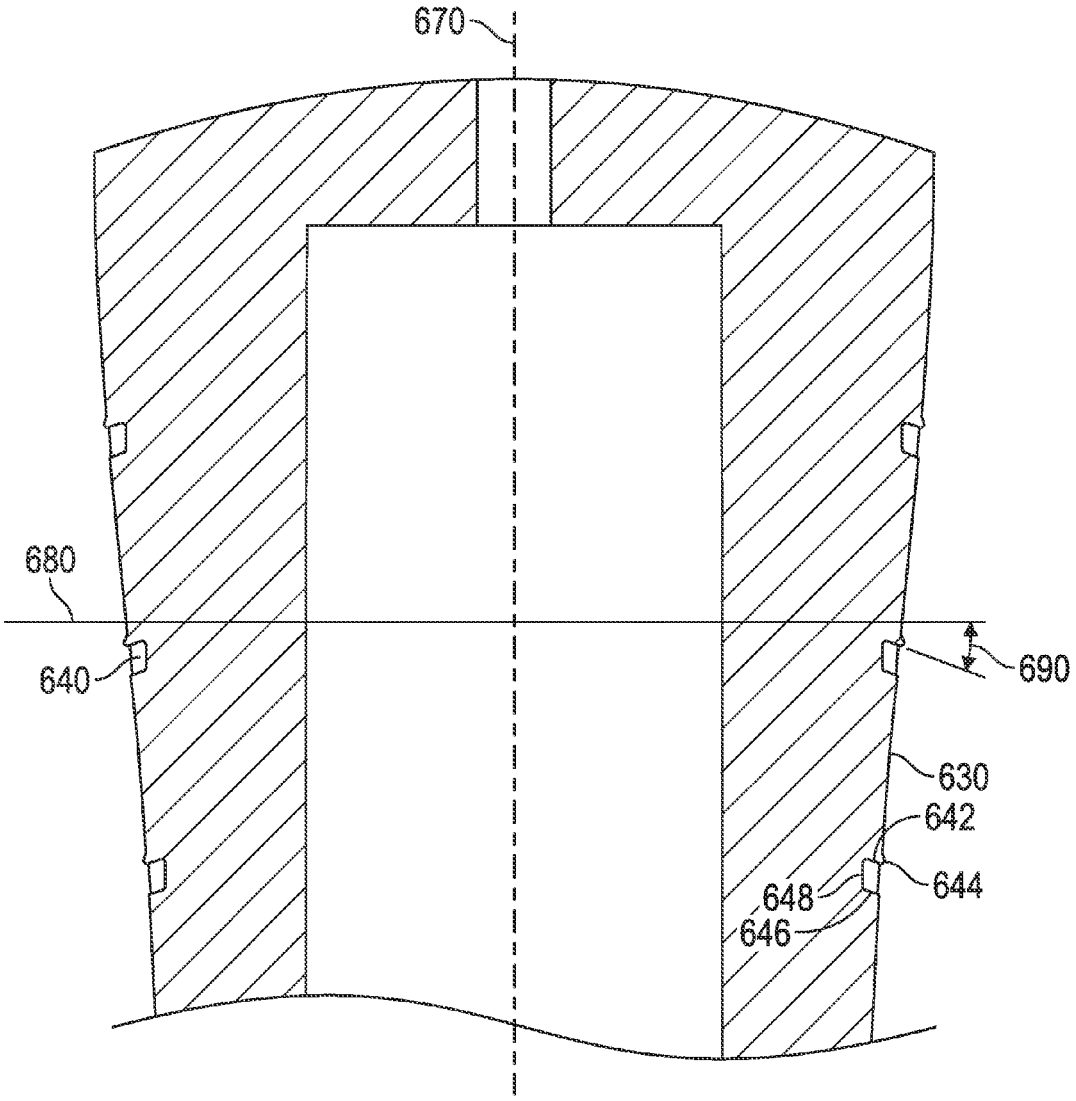
FIG. 14 is a cross-sectional view of a portion of the golf grip of FIG. 13 including the butt end.

FIG. 13 is a plan view of an exemplary golf grip 600 with raked gripping features 640. FIG. 14 is a cross-sectional view of a portion of grip 600 of FIG. 13 taken along line XIV-XIV. Referring to FIGS. 13 and 14, grip 600 has the shape of a hollow cylinder or tube extending from a closed butt end 610 to an open tip end 620. Grip 600 includes grip surface 630, the outer surface of the cylindrical shape. Grip surface 630 extends between butt end 610 and tip end 620. In the embodiment shown, the closed portion of butt end 610 and the cylindrical portion of grip 600 are a single integral piece; butt end 610 does not include a separate end cap.

Grip 600 also includes multiple gripping features 640. Gripping features 640 recede into grip 600 at grip surface 630 and may include a small protrusion 644. In the embodiment shown in FIG. 13, gripping feature 140 is rectangular in shape.

Referring now to FIG. 14, each gripping feature 640 rakes into grip 600 at an inclination from plane 680 at angle 690, rakes into grip 600 at an inclination from a plane that includes axis 670 (as illustrated in FIGS. 8 and 9), or at an inclination from a golfer's hand. Plane 680 is perpendicular to axis 670. Angle 690 may be angled from plane 670 towards tip end 620. Angle 690 is an acute angle. In one embodiment, angle 690 is between zero and ninety degrees. In another embodiment, angle 690 is from three to eighty-seven degrees. In another embodiment, angle 690 is from five to eighty-five degrees. In another embodiment, angle 690 is from fifteen to seventy-five degrees. In yet another embodiment, angle 690 is from ten to fifty degrees. The angle formed relative to a golfer's hand may equal or be similar to the complementary angle of angle 690. Each gripping feature 640 may curve as it extends into grip 100.

Each gripping feature 640 may include rake surface 642, protrusion 644, offset surface 646, and internal surface 648. Rake surface 642 may extend into grip 600 or out from grip surface 630. Rake surface 642 is angled at angle 690 and forms an acute angle with grip surface 630. Rake surface 642 may be the portion of a curved or cylindrical surface that forms an acute angle with grip surface 630. Rake surface 642 may be the surface of gripping feature 640 partially facing the direction the force gripping feature 640 is designed to oppose. In the embodiment shown in FIG. 14, rake surface 642 is partially facing in the axial direction towards tip end 620. For a curved rake surface 642, the tangential or radial angle of the curved rake surface 642 at grip surface 630 would be the same as angle 690.

Protrusion 644 extends from grip surface 630 adjacent to or behind rake surface 642. Protrusion 644 may form an edge or a round with rake surface 642. Protrusion 644 may provide extra material behind rake surface 642. In the embodiment shown in FIG. 14, protrusion 644 has a bulbous cross-section that curves out from grip surface 630 before forming a round with rake surface 642.

Each offset surface 646 and each internal surface 648 of gripping feature 640 may be situated and constructed in the same or a similar manner as offset surface 646 and internal surface 648 respectively. In the embodiment shown in FIG. 14, offset surface 646 and internal surface 648 include a fillet there between, and internal surface 648 and rake surface 642 form a fillet there between.

Figure 15:
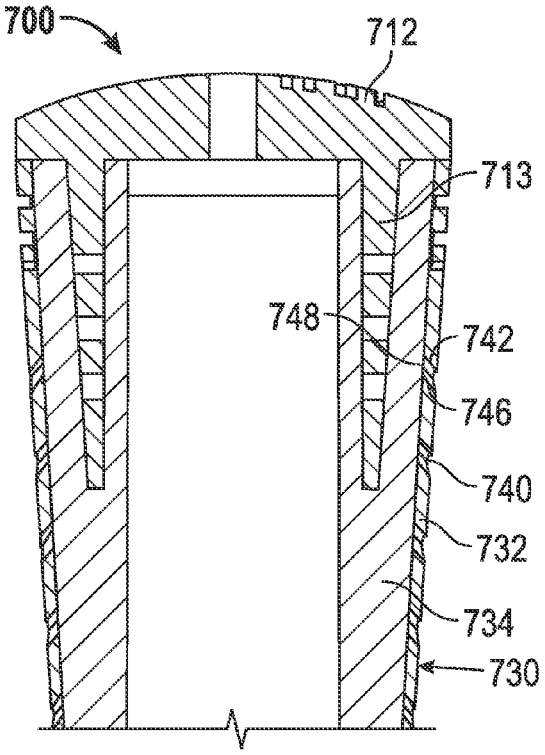
FIG. 15 is a cross-sectional view of an exemplary golf grip 700.

FIG. 15 is a cross-sectional view of an exemplary golf grip 700. Referring to FIG. 15, grip 700 includes an outer layer 732 and an inner layer 734. Inner layer 734 is located adjacent outer layer 732 and inside of outer layer 732. Grip surface 730 is the outer surface of outer layer 732. Outer layer 732 is made from a first material and inner layer 734 is made from a second material that is different than the first material. Grip 700 may also include endcap 712. Endcap 712 includes securing feature 713 that extends into inner layer 734 to secure endcap 712 to inner layer 734. Endcap 712 may be made from the first material, the second material, or a third material that is different than the first material or the second material.

Grip 700 includes gripping features 740. Each gripping feature 740 includes rake surface 742, and may include offset surface 746 and internal surface 748. Gripping feature 740 extends into grip 700 through outer layer 732. Gripping feature 740 extends to or into inner layer 734 exposing inner layer 734. Internal surface 748 is located on inner layer 734. Rake surface 742, offset surface 746 and internal surface 748 are oriented in the same or in a similar manner as other rake surfaces, offset surfaces, and internal surfaces disclosed herein.

Figure 16:
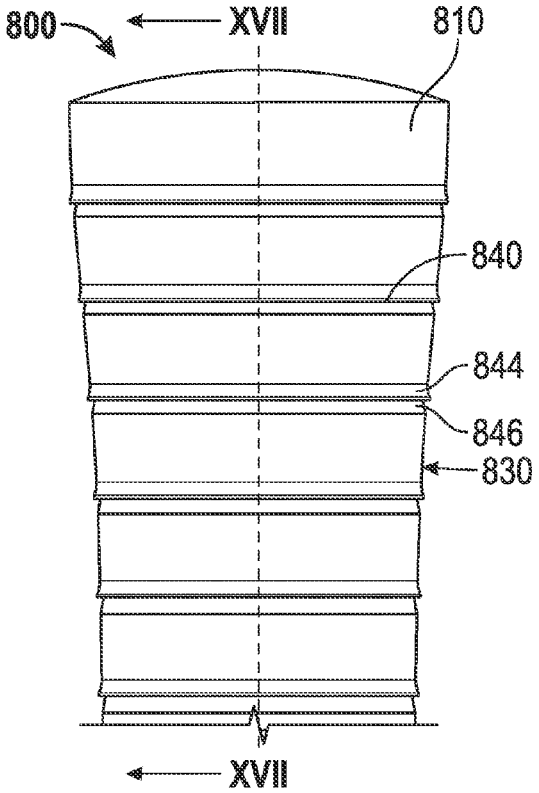
FIG. 16 is a plan view of an exemplary golf grip with annular raked gripping features.
Figure 17:
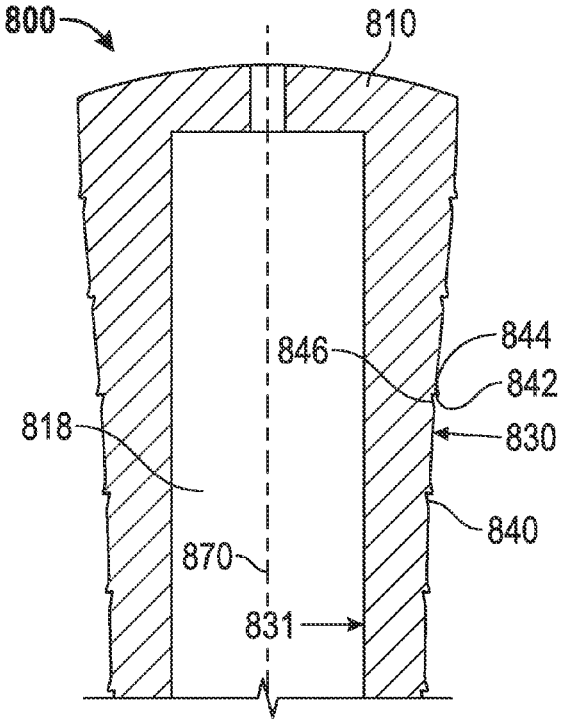
FIG. 17 is a cross-sectional view of the golf grip of FIG. 16.

FIG. 16 is a plan view of an exemplary golf grip 800 with annular raked gripping features 840 ("annular features"). FIG. 17 is a cross-sectional view of the golf grip 800 of FIG. 16 taken along line XVII-XVII. Referring to FIGS. 16 and 17, grip 800 may have the shape of a hollow cylinder or tube extending from a closed butt end 810 to an open tip end (not shown). Grip 800 includes grip surface 830, the outer surface of the cylindrical shape. Grip surface 830 extends between butt end 810 and the tip end. Grip surface 830 may taper from butt end 810 to the tip end with the width or diameter of grip surface 830 getting progressively smaller from butt end 810 to the tip end. The cross-section of grip 800 at grip surface 130 may be a circle, an ellipse, a stadium shape, or other similar shapes.

Grip 800 includes shaft cavity 818. Shaft cavity 818 is the hollow portion of grip 800 sized relative to the diameter of the shaft. Shaft cavity 818 extends from a shaft opening at the tip end towards butt end 810. Shaft cavity 818 is generally a right circular cylinder and includes shaft mating surface 831. Shaft mating surface 831 may be a right cylindrical surface. Grip 800 may include axis 870. Axis 870 may be the axis of the cylindrical shape of grip 800, the axis of shaft cavity 818, and the axis of shaft mating surface 831.

Grip 800 also includes multiple annular features 840 extending about grip surface 830. Each Annular features 840 may be a ring extending around grip 800 perpendicular to axis 870 or a ring segment extending partially around grip 800. Annular features 840 partially protrude from and partially recede into grip 800 at grip surface 830. Each annular feature 840 includes protrusion 844, rake surface 842, and offset surface 846.

Protrusion 844 may be an annular protrusion extending out from grip surface 830 and includes protruding surface 845 and a portion of rake surface 842. Protruding surface 845 may have a linear or curved profile extending from grip surface 830 to rake surface 842. Protruding surface 845 may extend out from grip surface 830 and in a first axial direction. The first axial direction may be towards the tip end or butt end 810. The intersections between protruding surface 845 and grip surface 830, and protruding surface 845 and rake surface 842 may be rounded.

Protruding surface 845 with a linear profile extends outward from grip surface 830 at an acute angle towards the tip end of grip 800 to rake surface 842. In one embodiment the acute angle is from five to forty-five degrees. In another embodiment the acute angle is from ten to thirty degrees. Protruding surface 845 with a curved profile extends outward from grip surface 830 to rake surface 842. Protruding surface 845 may be a concave plane or may be a sinusoidal plane extending in the axial direction that extends from grip surface 830 with a concave profile that transitions into a convex profile.

Offset surface 846 may also have a curved or linear profile extending from grip surface 830 to rake surface 842. Offset surface 846 may extend into grip 800 from grip surface 830 and in a second axial direction. The second axial direction is opposite the first axial direction. The intersections between offset surface 846 and grip surface 830, and offset surface 846 and rake surface 842 may be rounded.

Offset surface 846 with a linear profile extends into grip 800 from grip surface 830 at an acute angle to rake surface 842. In one embodiment the acute angle is from five to forty-five degrees. In another embodiment the acute angle is from ten to thirty degrees. Offset surface 846 with a curved profile extends into grip 800 from grip surface 830 to rake surface 842. Offset surface 846 may be a convex plane or a sinusoidal plane extending in the second axial direction and into grip 800 with a convex profile that transitions into a concave profile.

Rake surface 842 extends into grip 800 towards axis 870. The portion of rake surface 842 adjacent grip surface 830 is angled toward axis 870 and in the second axial direction. Rake surface 842 may have a linear or curved profile. Rake surface 842 with a linear profile extends into grip 800 perpendicular to axis 870 or angled toward the axis and toward the second axial direction. In one embodiment, rake surface 842 extends into grip 800 angled from the perpendicular direction between zero and forty five degrees. In another embodiment, rake surface 842 extends into grip 800 angled from the perpendicular direction from one to thirty degrees.

Rake surface 842 with a curved profile may have a concave profile, a convex profile, or a sinusoidal profile. The initial direction of rake surface 842 with a concave, convex, or sinusoidal profile may be perpendicular to axis 870 or toward the axis and the second axial direction. In one embodiment, the initial direction or vector of rake surface 842 is angled from the direction perpendicular to the axis 870 between zero and forty five degrees. In another embodiment, the initial direction or vector of rake surface 842 is angled from the direction perpendicular to the axis 870 from one to thirty degrees.

Golf grips with raked gripping features may be made from materials such as rubber, polyurethane, TPE, foams, or similar elastomeric and shock absorbing materials. Golf grips may also be composites and may include fibers, cords, fabric, or cork imbedded within the elastomeric materials.

Golf grips with gripping features may help a golfer retain the golf club securely in the golfer's hands. Gripping features raked relative to a golfer's hands may improve the traction or friction between the grip and the golfer's hands to help a golfer retain the club securely in the golfer's hands. A golf grip with raked gripping features may improve traction by creating a mechanical interface with the golfer's hand. Improved traction may allow the golfer to grip the golf club with a lighter grip or less grip pressure. Gripping a golf club with less grip pressure may reduce the tension in the muscles of the golfer, allowing a golfer to maintain a faster and more fluid swing, which correlates to greater distances and accuracy of golf shots.

The rake of the gripping feature may be angled in the direction of an axial or inertial force (centrifugal force). The inertia of the golf club during a golf swing tends to pull the golf club away from the golfer. This inertial force may be generally in the axial direction of the golf club in the direction of the club head. The gripping features with rake angles in the axial direction of the inertial force may increase traction for any possible movement of the golfer's hand relative to the grip in the direction against the grain of the rake or in the direction opposite a component of the rake angle.

The rake may also be angled in the direction of a circumferential or rotational force (torque). Various forces throughout a golf swing may apply a torque to the golf club, such as off center hits of a golf ball relative to the club head. Similar to counteracting inertial forces, gripping features with rake angles in the direction of the torque may increase traction for any possible twisting of the grip in the golfer's hand in the direction against the grain of the rake or in the direction opposite a component of the rake angle.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

What is claimed is:

1. A golf grip for a golf club comprising:
a butt end;
a tip end having a shaft opening;
a grip surface extending between the butt end and the tip end, the grip surface being a tapered circular cylinder with an axis extending from the butt end to the tip end; and
a plurality of gripping features, each including a slot extending along the grip surface and in a plane perpendicular to the axis, the slot having
a rake surface extending into the grip at an acute angle relative to the plane; wherein multiple gripping features of the plurality of gripping features are aligned circumferentially along the grip surface.

2. The golf grip of claim 1, wherein the rake surface forms an acute angle with the grip surface.

3. The golf grip of claim 1, wherein the rake surface is angled towards the butt end.

4. The golf grip of claim 1, wherein the rake surface is angled towards the tip end.

5. The golf grip of claim 1, wherein the slot of each of the gripping features of the plurality of gripping features includes an offset surface spaced apart from the rake surface.

6. The golf grip of claim 1, further comprising
a second plurality of second gripping features, each receding into the grip, each of the second gripping features of the second plurality of second gripping features having
a second rake surface extending into the grip forming an acute angle relative to a second plane that includes the axis;
wherein each of the second gripping features of the second plurality of second gripping features has a shape that is different than the shape of each of the gripping features of the plurality of gripping features.

7. The golf grip of claim 1, further comprising
a second plurality of second gripping features, each second gripping feature of the second plurality of gripping features having
a second rake surface extending into the grip forming an acute angle with the grip surface.

8. The golf grip of claim 7, wherein the golf grip is divided into a first section and a second section, and the first section includes the plurality of gripping features and the second section includes the second plurality of the second gripping features.

9. A golf club including the golf grip of claim 1.

10. A putter including the golf grip of claim 1.

11. A golf grip for a golf club comprising:
a butt end;
a tip end having a shaft opening;
a grip surface extending between the butt end and the tip end, the grip surface being a tapered circular cylinder with an axis extending from the butt end to the tip end; and
a gripping feature including an indentation raking into the grip from the grip surface, the indentation having
a rake surface extending into the grip forming an acute angle with the grip surface, the rake surface and the grip surface forming a rake edge that extends circumferentially along the grip surface in a plane perpendicular to the axis and faces towards the tip end.

12. The golf grip of claim 11, wherein the rake surface extends into the grip at an acute angle relative to a plane that includes the golf grip axis.

13. The golf grip of claim 11, wherein the gripping feature includes an offset surface spaced apart from the rake surface.

14. The golf grip of claim 11, further comprising a second gripping feature including a second rake surface extending into the grip forming an acute angle with the grip surface, the second rake surface being angled in the clockwise direction when looking from the tip end towards the butt end, wherein the second rake surface and the grip surface form a second rake edge that extends along the grip surface in the axial direction in a second plane that includes the axis.

15. A golf club including the golf grip of claim 11.

16. A putter including the golf grip of claim 11.

17. A golf grip for a golf club comprising:
a butt end;
a tip end;
a grip surface extending between the butt end and the tip end;
a shaft mating surface extending from the tip end towards the butt end and located inward from the grip surface, the shaft mating surface having a cylindrical shape with an axis extending from the tip end towards the butt end;
a gripping feature having
an indentation extending along the grip surface and in a plane perpendicular to the axis, the indentation raking into the grip from the grip surface towards the shaft mating surface, the indentation including a rake surface extending into the grip from the grip surface, wherein a portion of the rake surface adjacent to the grip surface is angled to form an acute angle with the plane perpendicular to the axis; and
a second gripping feature having
a second indentation raking into the grip from the grip surface towards the shaft mating surface, the second indentation including a second rake surface extending into the grip from the grip surface, wherein a second portion of the second rake surface adjacent to the grip surface is angled to form an acute angle with a second plane that includes the axis.

18. The golf grip of claim 17, wherein the grip surface includes a rake edge formed between the rake surface and the grip surface, the rake edge extending along the grip surface and in the plane perpendicular to the axis.

19. The golf grip of claim 18, wherein the grip surface includes a second rake edge formed between the second rake surface and the grip surface, the second rake edge extending in the axial direction along the grip surface.

* * * * *